US010851663B2

(12) United States Patent
Dutta et al.

(10) Patent No.: US 10,851,663 B2
(45) Date of Patent: Dec. 1, 2020

(54) TURBOMACHINE ROTOR BLADE

(71) Applicant: General Electric Company, Schenectady, NY (US)

(72) Inventors: Sandip Dutta, Greenville, SC (US); Joseph Anthony Weber, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 418 days.

(21) Appl. No.: 15/619,600

(22) Filed: Jun. 12, 2017

(65) Prior Publication Data

US 2018/0355730 A1 Dec. 13, 2018

(51) Int. Cl.
*F01D 5/18* (2006.01)
*F01D 11/04* (2006.01)

(52) U.S. Cl.
CPC ..... *F01D 11/04* (2013.01); *F01D 5/188* (2013.01)

(58) Field of Classification Search
CPC ..... F01D 5/188; F01D 5/189
See application file for complete search history.

(56) References Cited

U.S. PATENT DOCUMENTS 3,623,825 A 11/1971 Schneider
3,846,041 A * 11/1974 Albani ..... B23P 15/04 416/97 R
4,142,831 A * 3/1979 Dakin ..... F01D 5/185 416/96 A
4,218,179 A * 8/1980 Barry ..... F01D 5/189 415/114
4,259,037 A * 3/1981 Anderson ..... F01D 5/185 416/96 R
4,542,867 A * 9/1985 Memmen ..... F01D 5/188 244/117 A
4,859,141 A * 8/1989 Maisch ..... B23P 11/025 415/115
5,207,556 A * 5/1993 Frederick ..... F01D 5/189 415/115
5,762,471 A * 6/1998 Cunha ..... F01D 5/189 415/115
6,193,465 B1 * 2/2001 Liotta ..... B23P 15/04 29/889.722
6,811,378 B2 11/2004 Kraft
(Continued)

OTHER PUBLICATIONS http://www.finnedtube.com/perforated-fin-tubes.

*Primary Examiner* — Justin D Seabe
(74) *Attorney, Agent, or Firm* — Dority & Manning, P.A.

(57) ABSTRACT

The present disclosure is directed to a rotor blade for a turbomachine. The rotor blade includes an airfoil defining a passage extending from a root to a tip of the airfoil. The passage includes a first passage portion and a second passage portion. The first passage portion has a greater diameter than the second passage portion. The rotor blade also includes a first tube positioned within the first passage portion. The first tube is spaced apart from the airfoil. The rotor blade further includes a second tube positioned within the first passage portion. The second tube is positioned between the airfoil and the first tube. Furthermore, the rotor blade includes a plurality of inserts positioned within the first passage portion. The plurality of inserts is positioned between and in contact with the first and second tubes.

19 Claims, 5 Drawing Sheets

(56) References Cited

U.S. PATENT DOCUMENTS

| | | | | |
|---|---|---|---|---|
| 7,780,413 | B2 * | 8/2010 | Liang | F01D 5/188 416/97 R |
| 10,113,441 | B2 * | 10/2018 | Propheter-Hinckley | F01D 9/02 |
| 2014/0161625 | A1 * | 6/2014 | Zhang | F01D 5/187 416/96 R |
| 2014/0348636 | A1 * | 11/2014 | Buhler | F01D 9/02 415/115 |

* cited by examiner

TURBOMACHINE ROTOR BLADE

FIELD

The present disclosure generally relates to turbomachines. More particularly, the present disclosure relates to inserts for rotor blades for turbomachines.

BACKGROUND

A gas turbine engine generally includes a compressor section, a combustion section, and a turbine section. The compressor section progressively increases the pressure of air entering the gas turbine engine and supplies this compressed air to the combustion section. The compressed air and a fuel (e.g., natural gas) mix within the combustion section and burn in a combustion chamber to generate high pressure and high temperature combustion gases. The combustion gases flow from the combustion section into the turbine section where they expand to produce work. For example, the expansion of the combustion gases in the turbine section may rotate a rotor shaft coupled to a generator to produce electricity.

The turbine section generally includes a plurality of rotor blades, which extract kinetic energy and/or thermal energy from the combustion gases flowing through the turbine section. In this respect, each rotor blade includes an airfoil positioned within the flow of the combustion gases. Since the airfoils operate in a high temperature environment, it may be necessary to cool the rotor blades.

In certain configurations, cooling air is routed through one or more cooling passages defined by the rotor blade to provide cooling thereto. Typically, this cooling air is compressed air bled from the compressor section. Bleeding air from the compressor section, however, reduces the volume of compressed air available for combustion, thereby reducing the efficiency of the gas turbine engine.

BRIEF DESCRIPTION

Aspects and advantages of the technology will be set forth in part in the following description, or may be obvious from the description, or may be learned through practice of the technology.

In one aspect, the present disclosure is directed to a rotor blade for a turbomachine. The rotor blade includes an airfoil defining a passage extending from a root to a tip of the airfoil. The passage includes a first passage portion and a second passage portion. The first passage portion has a greater diameter than the second passage portion. The rotor blade also includes a first tube positioned within the first passage portion. The first tube is spaced apart from the airfoil. The rotor blade further includes a second tube positioned within the first passage portion. The second tube is positioned between the airfoil and the first tube. Furthermore, the rotor blade includes a plurality of inserts positioned within the first passage portion. The plurality of inserts is positioned between and in contact with the first and second tubes.

In another aspect, the present disclosure is directed to a turbomachine including a turbine section having one or more rotor blades. Each rotor blade includes an airfoil defining a passage extending from a root to a tip of the airfoil. The passage includes a first passage portion and a second passage portion. The first passage portion has a greater diameter than the second passage portion. The rotor blade also includes a first tube positioned within the first passage portion. The first tube is spaced apart from the airfoil. The rotor blade further includes a second tube positioned within the first passage portion. The second tube is positioned between the airfoil and the first tube. Furthermore, the rotor blade includes a plurality of inserts positioned within the first passage portion. The plurality of inserts is positioned between and in contact with the first and second tubes.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
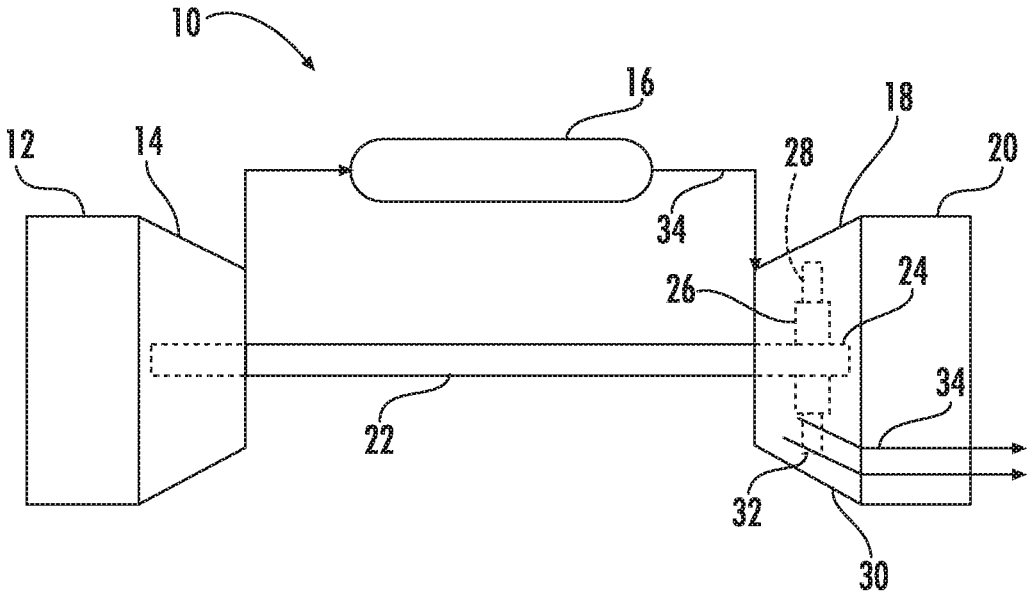
FIG. 1 is a schematic view of an exemplary gas turbine engine in accordance with the embodiments disclosed herein.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, wherein identical numerals indicate the same elements throughout the figures, FIG. 1 schematically illustrates a gas turbine engine 10. The gas turbine engine 10 may include an inlet section 12, a compressor section 14, a combustion section 16, a turbine section 18, and an exhaust section 20. The compressor section 14 and turbine section 18 may be coupled by a shaft 22. The shaft 22 may be a single shaft or a plurality of shaft segments coupled together to form the shaft 22.

The turbine section 18 may generally include a rotor shaft 24, a plurality of rotor disks 26 (one of which is shown), and a plurality of rotor blades 28. More specifically, the plurality of rotor blades 28 may extend radially outward from and interconnect with one of the rotor disks 26. Each rotor disk 26, in turn, may couple to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, air or another working fluid flows through the inlet section 12 and into the compressor section 14, where the air is progressively compressed to provide pressurized air to the combustors (not shown) in the combustion section 16. The pressurized air mixes with fuel and burns within each combustor to produce combustion gases 34. The combustion gases 34 flow along the hot gas path 32 from the combustion section 16 into the turbine section 18. In the turbine section 18, the rotor blades 28 extract kinetic and/or thermal energy from the combustion gases 34, thereby causing the rotor shaft 24 to rotate. The mechanical rotational energy of the rotor shaft 24 may then be used to power the compressor section 14 and/or to generate electricity. The combustion gases 34 exiting the turbine section 18 may then be exhausted from the gas turbine engine 10 via the exhaust section 20.

Figure 2:
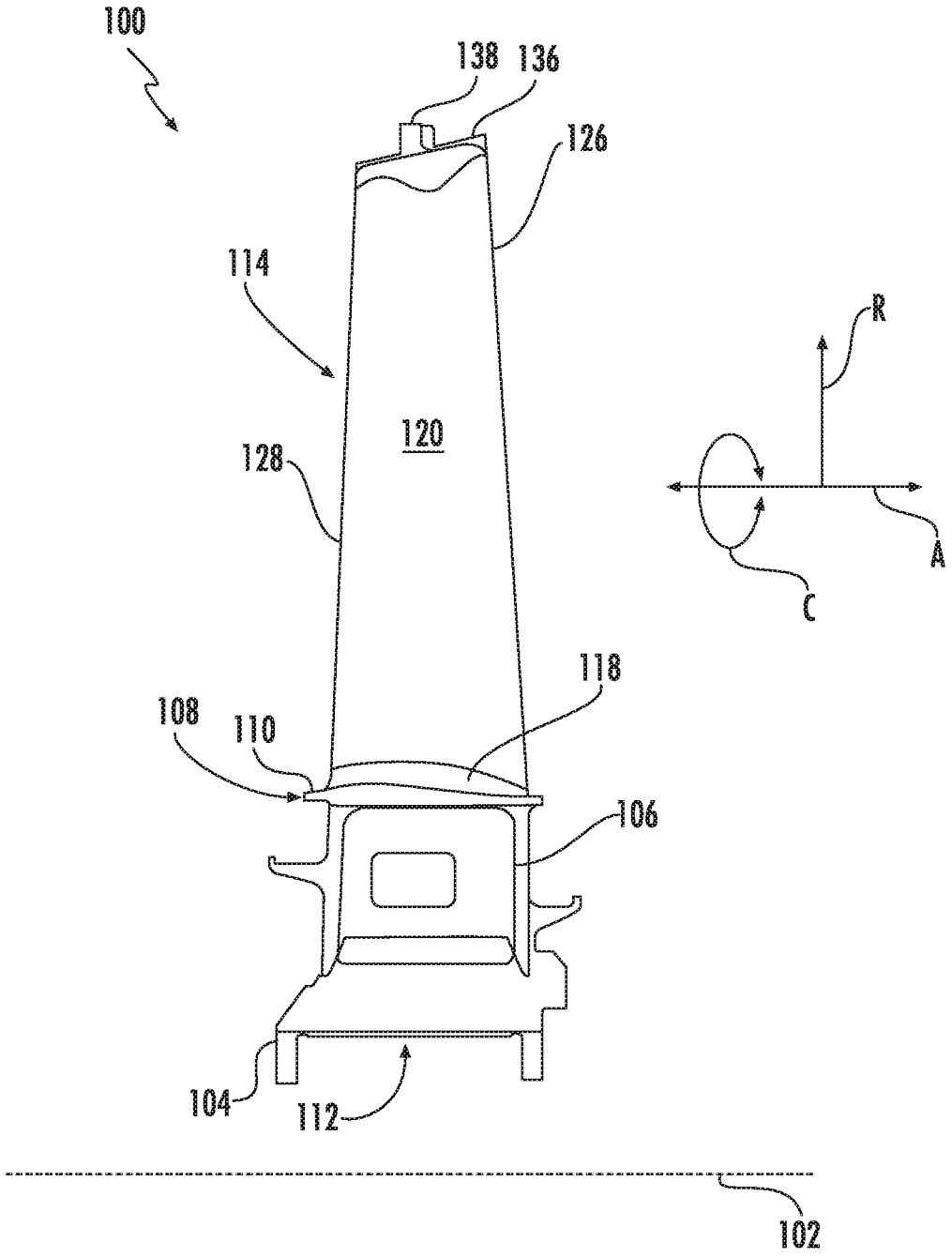
FIG. 2 is a front view of an exemplary rotor blade in accordance with the embodiments disclosed herein.

FIG. 2 is a view of an exemplary rotor blade 100, which may be incorporated into the turbine section 18 of the gas turbine engine 10 in place of one or more of the rotor blades 28. As shown, the rotor blade 100 defines an axial direction A, a radial direction R, and a circumferential direction C. In general, the axial direction A extends parallel to an axial centerline 102 of the shaft 24 (FIG. 1), the radial direction R extends generally orthogonal to the axial centerline 102, and the circumferential direction C extends generally concentrically around the axial centerline 102.

As illustrated in FIG. 2, the rotor blade 100 may include a dovetail 104, a shank portion 106, and a platform 108. More specifically, the dovetail 104 secures the rotor blade 100 to the rotor disk 26 (FIG. 1). The shank portion 106 couples to and extends radially outward from the dovetail 104. The platform 108 couples to and extends radially outward from the shank portion 106. The platform 108 includes a radially outer surface 110, which generally serves as a radially inward flow boundary for the combustion gases 34 flowing through the hot gas path 32 of the turbine section 18 (FIG. 1). The dovetail 104, shank portion 106, and/or platform 108 may define an intake port 112, which permits coolant (e.g., compressed air bled from the compressor section 14) to enter the rotor blade 100. In the embodiment shown in FIG. 2, the dovetail 104 is an axial entry fir tree-type dovetail. Alternately, the dovetail 104 may be any suitable type of dovetail. In fact, the dovetail 104, shank portion 106, and/or platform 108 may have any suitable configurations.

Figure 3:
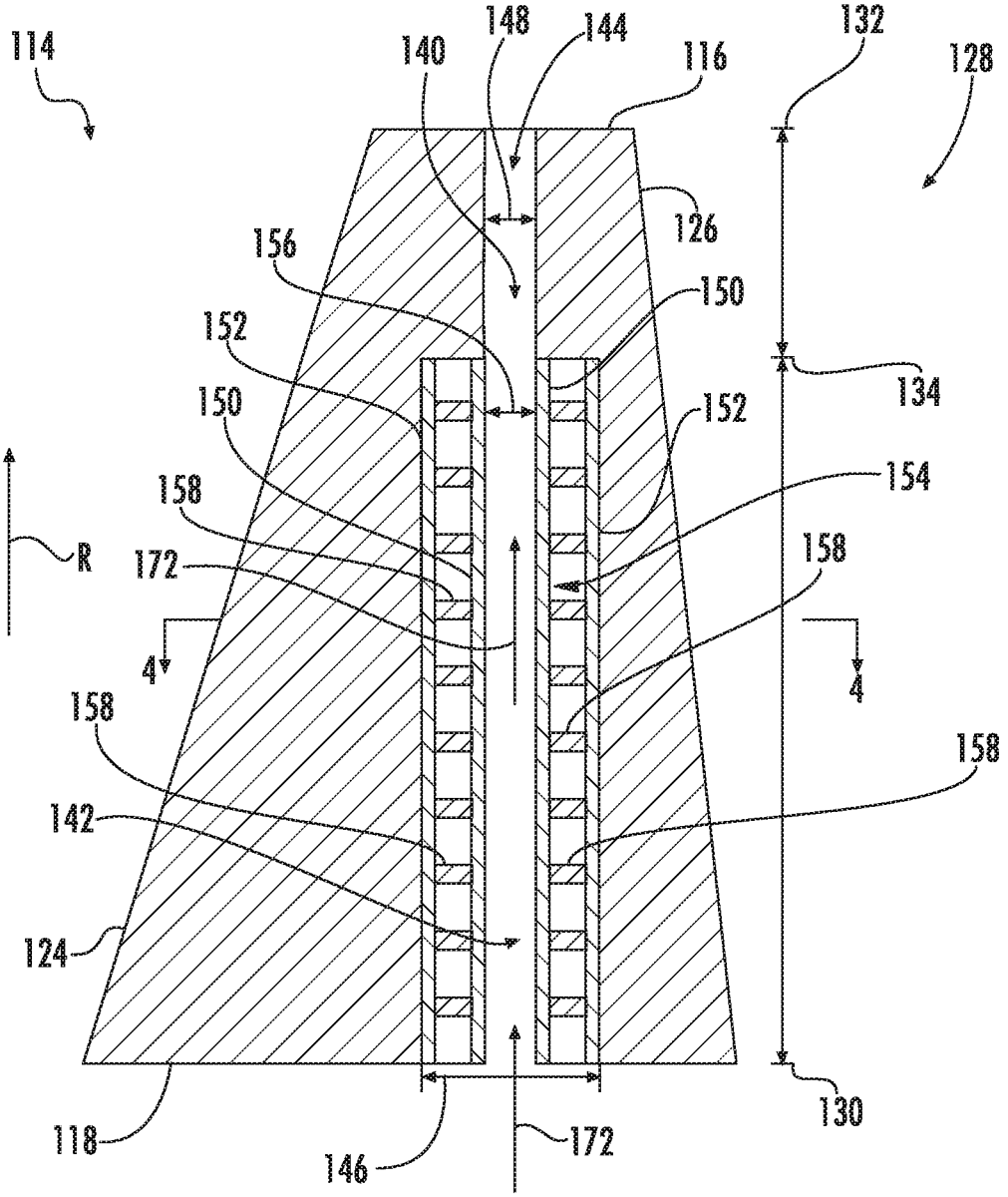
FIG. 3 is a cross-sectional view of an airfoil in accordance with the embodiments disclosed herein.
Figure 4:
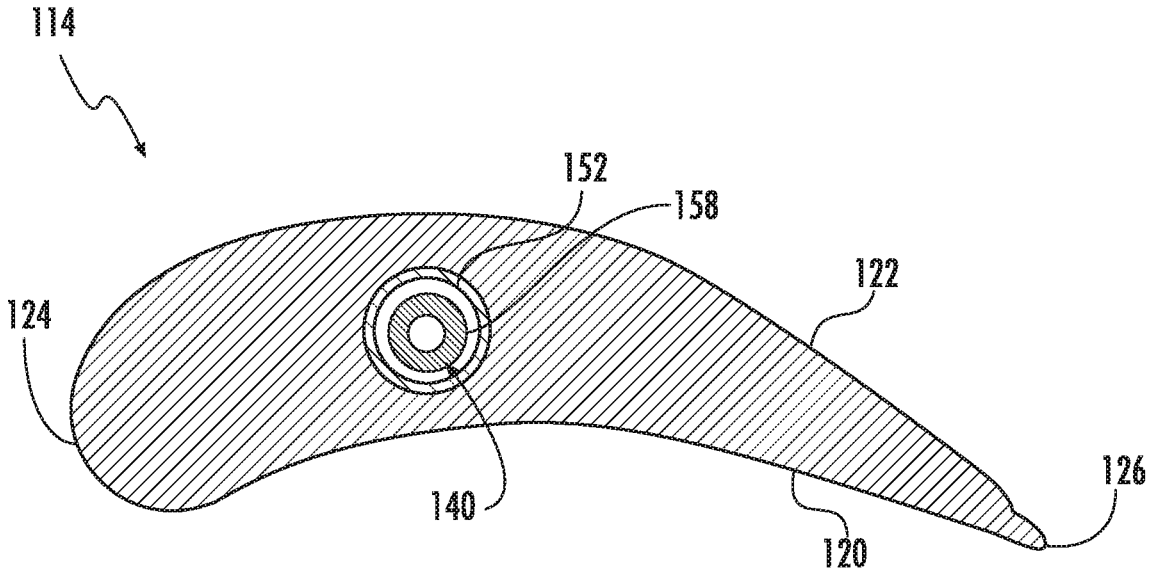
FIG. 4 is a cross-sectional view of the airfoil taken generally about line 4-4 in FIG. 3, illustrating the relative positioning between first and second tubes of the cooling insert in accordance with the embodiments disclosed herein.

Referring now to FIGS. 2 and 3, the rotor blade 100 further includes an airfoil 114. In particular, the airfoil 114 extends radially outward from the radially outer surface 110 of the platform 108 to a tip 116. As such, the airfoil 114 couples to the platform 108 at a root 118 (i.e., the intersection between the airfoil 114 and the platform 108). The airfoil 114 also includes a pressure side surface 120 and an opposing suction side surface 122 (FIG. 4). The pressure side surface 120 and the suction side surface 122 are joined together or interconnected at a leading edge 124 of the airfoil 114, which is oriented into the flow of combustion gases 34 (FIG. 1). The pressure side surface 120 and the suction side surface 122 are also joined together or interconnected at a trailing edge 126 of the airfoil 114 spaced downstream from the leading edge 124. The pressure side surface 120 and the suction side surface 122 are continuous about the leading edge 124 and the trailing edge 126. The pressure side surface 120 is generally concave, and the suction side surface 122 is generally convex.

As shown in FIG. 3, the airfoil 114 defines a span 128 extending from the root 118 to the tip 116. The root 118 is positioned at zero percent of the span 128, and the tip 116 is positioned at one hundred percent of the span 128. As shown, zero percent of the span 128 is identified by 130, and one hundred percent of the span 128 is identified by 132. Furthermore, seventy-five percent of the span 128 is identified by 134. Various other positions (e.g., twenty-five percent, fifty percent, etc.) along the span 128 may also be defined.

In the embodiment shown in FIG. 2, the rotor blade 100 includes the tip shroud 136 coupled to the tip 116 of the airfoil 114. In this respect, the tip shroud 136 may generally define the radially outermost portion of the rotor blade 100. The tip shroud 136 reduces the amount of the combustion gases 34 (FIG. 1) that escape past the rotor blade 100. In certain embodiments, the tip shroud 136 may include a seal rail 138 extending radially outward therefrom. Alternate embodiments, however, may include more seal rails 138 (e.g., two seal rails 138, three seal rails 138, etc.) or no seal rails 138 at all. Although not shown, the tip shroud 136 may define various cavities, passages, and apertures for routing coolant therethrough. Nevertheless, some embodiments of the rotor blade 100 may not include the tip shroud 136.

As illustrated in FIGS. 3 and 4, the airfoil 114 defines one or more passages 140 extending therethrough. In the embodiment shown, the airfoil 114 defines one passage 140 positioned along a camber line (not shown) of the airfoil 114. In alternate embodiments, however, the airfoil 114 may define more passages 140 (e.g., two, three, four, or more passages 140) and the passages 140 may be positioned or arranged in any suitable manner.

The passage 140 may fluidly couple various portions of the rotor blade 100. More specifically, the passage 140 extends from the root 118 of the airfoil 114 to the tip 116 of the airfoil 114. In this respect, the passage 140 may be fluidly coupled to the intake port 112. The passage 140 may also be fluidly coupled to any cavities or apertures (not shown) defined by the tip shroud 136. Other portions (e.g., the platform 108, the shank 106, etc.) of the rotor blade 100 may define portions of the passages 140 in certain embodiments.

The passage 140 includes a first passage portion 142 and second passage portion 144. More specifically, the first passage portion includes a first passage portion diameter 146, and the second passage portion includes a second passage portion diameter 148. As shown, the first passage portion diameter 146 is greater than the second passage portion diameter 148. In the embodiment shown in FIG. 3, the first passage portion 142 may extend from zero percent 130 of the span 128 to seventy-five percent 134 of the span 128. In this respect, the first passage portion 142 may extend from seventy-five percent 134 percent 130 of the span 128 to one hundred percent 132 of the span 128. In alternate embodiments, however, the first and second passage portions 142, 144 may location at other portions of the span 128 so long as the first passage portion 142 is positioned radially inward from the second passage portion 144.

Figure 5:
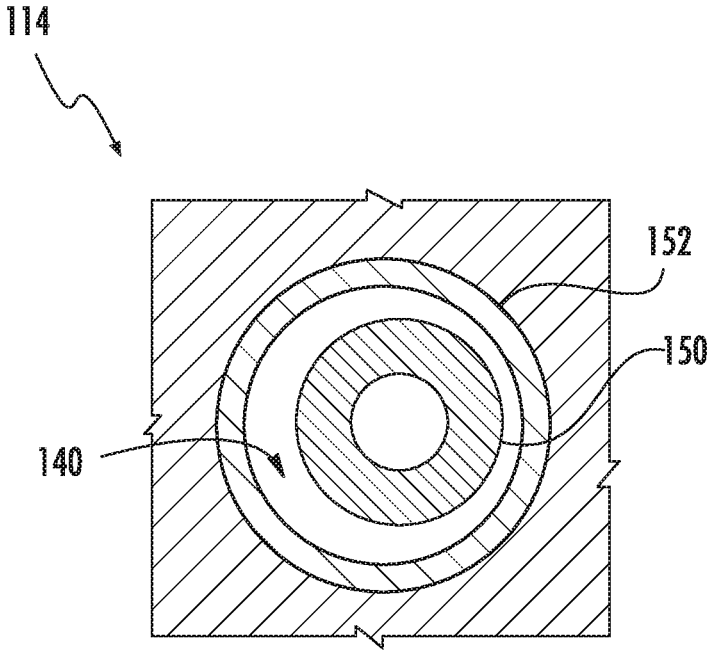
FIG. 5 is a cross-sectional view of a portion of an airfoil, illustrating an alternate embodiment of the relative positioning between first and second tubes of the cooling insert in accordance with the embodiments disclosed herein.

The rotor blade 100 further includes a first tube 150 and a second tube 154 positioned within the first passage portion 142. As shown in FIGS. 4 and 5, the first tube 150 is spaced apart from the airfoil 114. The second tube 152 is positioned between the airfoil 114 and the first tube 150. In this respect, a gap 154 may be defined between the first and second tubes 150, 152. The second tube 152 may be in contact with the first tube 150. Furthermore, a first tube inner diameter 156 of the first tube 150 may be the same as or substantially similar to the second passage portion diameter 148. In some embodiments, the first and second tubes 150, 152 may be concentric about each other as shown in FIGS. 3 and 4. In alternate embodiments, however, the first and second tubes 150, 152 may be non-concentric arranged as illustrated in FIG. 5. In embodiments a plurality of passages 140, the first and second tubes 150, 152 may be placed in any number of the passages 140 so long as at least one passage 140 includes the first and second tubes 150, 152.

A plurality of inserts 158 is positioned within the first passage portion 142 between the first and second tubes 150, 152. More specifically, the inserts 158 are in contact with both the first tube 150 and the second tube 152. For example, each insert 158 may be integrally coupled to or fixedly coupled to one of the first or second tubes 150, 152 and in sliding engagement with the other of the first or second tubes 150, 152. In alternate embodiments, each insert 158 may be fixedly coupled to both of the first and second tubes 150, 152. As will be discussed in greater detail below, each insert 158 permits heat to conduct from the second tube 152 to the first tube 150. In this respect, the number and placement of the inserts 158 within the first passage portion 142 may control the rate of heat transfer between the first and second tubes 150, 152. In the embodiment shown, ten inserts 158 are positioned within the first passage portion 142. In alternate embodiments, any suitable number of inserts 158 may be positioned within the first passage portion 142. In embodiments that do not include the second tube 152, the inserts 158 may directly couple to the airfoil 114

FIG. 3 illustrates one embodiment of the positioning of the inserts 158 within the first passage portion 142. In the embodiment shown, the first passage portion 142 extends from zero percent 130 of the span 128 to seventy-five percent 134 of the span 128. As such, the plurality of inserts 158 is similarly positioned from zero percent 130 of the span 128 to seventy-five percent 134 of the span 128. As such, no inserts 158 are positioned between seventy-five percent 134 of the span 128 and one hundred percent 132 of the span 128. In embodiments where the first passage portion 142 occupies a different portion of the span 128 (e.g., zero percent 130 of the span 128 to fifty percent of the span 128), the inserts 158 would also occupy this portion of the span 128.

Figure 6:
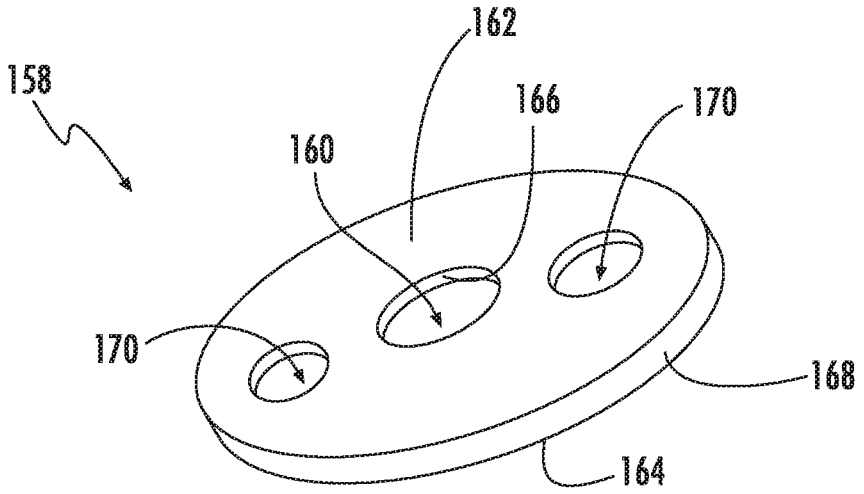
FIG. 6 is a perspective view of an exemplary insert in accordance with embodiments disclosed herein.

The inserts 158 are spaced apart from each other along the span 128 within the first passage portion 142. In the embodiment shown in FIG. 3, the inserts 158 may be non-uniformly spaced apart from each other within the first passage portion 142. For example, more of the plurality of inserts 158, such as twenty percent more inserts 158, may be positioned between zero percent 130 of the span 128 and twenty-five percent of the span 128 than between twenty-five percent of the span 128 and fifty percent of the span 128. Similarly, more of the plurality of inserts 158, such as twenty percent more inserts 158, may be positioned between twenty-five percent of the span 128 and fifty percent of the span 128 than between fifty percent of the span 128 and seventy-five percent 134 of the span 128. In alternate embodiments, however, the inserts 158 may be arranged in any suitable manner within the first passage portion 142 to provide the desired rate of heat transfer between the first and second tubes 150, 152. FIG. 6 illustrates an exemplary embodiment of one of the inserts 158. As shown, the insert 158 is generally an annular plate-like disk. In this respect, the insert 158 defines a central aperture 160 extending therethrough for receiving the first tube 150. The insert 158 also includes a top surface 162, a bottom surface 164, an inner side surface 166 that circumscribes the central aperture 160, and an outer side surface 168 that is in contact with the second tube 152. The insert 158 may also define one or more perforations 170 extending therethrough. As will be discussed in greater detail, the perforations 170 may permit coolant to flow through the space 154 between the first and second tubes 150, 152. In the embodiment shown, the insert 158 defines two perforations 170. Nevertheless, the insert 158 may define more or fewer perforations 170. In fact, in some embodiments, the insert 158 may define no perforations as shown in FIG. 3. In alternate embodiments, the insert 158 may have any suitable structure that permits the conduction of heat from the second tube 152 to first tube 150. For example, the inserts 158 may be a plurality of fins integrally or fixedly coupled to the first tube 150, such as axially- or helically-extending fins. The inserts 158 may also comprise a plurality of projections resembling a bottle brush. Furthermore, the inserts 158 may be a plurality of splines integrally or fixedly coupled to the second tube 152, such as axially- or helically-extending splines. Moreover, the inserts 158 may be complementary features integrally or fixedly coupled to both of the first and second tubes 150, 152 that threadingly engage each other (e.g., like screw threads). In operation, the cooling passage 140 provides coolant to the airfoil 114 and the tip shroud 138 (if included). More specifically, coolant 172 (identified by arrow 166 in FIG. 3), such as compressed air bled from the compressor section 14 (FIG. 1), may enter the rotor blade 100 via the intake port 112 (FIG. 2). As shown in FIG. 3, the coolant 172 then flows into the passage 140. Some or all of the coolant 172 flows through the first tube 150 and into the second passage portion 144 before exiting the airfoil 114 (e.g., by flowing into the tip shroud 136). In some embodiments, a portion of the coolant 172 may flow into the space 154 between the first and second tubes 150, 152. The perforations 170 defined by the inserts 158 may permit this portion of the coolant 172 to flow through the space 154.

The coolant 172 flowing through the first tube 150 and into the second passage portion 144 absorbs heat from the airfoil 114. More specifically, heat from the combustion gases 30 convectively transfers to the airfoil 114 of the rotor blade 100. This heat may then conduct through the airfoil 114 to the second tube 152. The ward the passages 134. The inserts 158 may then conductively transfer heat from second tube 152 to the first tube 150, which is convectively cooled by the coolant 172 flowing therethrough. Any coolant 172 present in the space 154 may convectively transfer additional heat from the second tube 152 to the first tube 150.

The configuration of the rotor blade 100 described herein reduces the heat transfer to the coolant 172 flowing through first passage portion 142. In particular, the coolant 172 flowing through the first tube 150 is partially isolated from the airfoil 114 and the second tube 152 by the space 154. In this respect, the inserts 158 allow some heat to transfer to the coolant 172 in the first tube 150, but less heat transfers through the inserts 158 than would transfer if the coolant 172 were in direct contact with the airfoil 114 and/or the second tube 152. The particular rate of heat transfer to the coolant 172 in the first tube 150 may be controlled based on the number and positioning of the inserts 158. For example, increasing the number of inserts 158 in the first passage portion 142 or decreasing the spacing between the inserts 158 increases the rate of heat transfer between the airfoil 114 and the coolant 172 flowing through the first tube 150. Conversely, decreasing the number of inserts 158 in the first passage portion 142 or increasing the spacing between the inserts 158 decreases the rate of heat transfer between the airfoil 114 and the coolant 172 in the first tube 150.

It may be necessary to preserve the cooling capacity of the coolant 172 flowing through the airfoil 114 so that the coolant 172 remains at a low enough temperature to sufficiently cool the radially outer portions of the airfoil 114. In this respect, the inserts 158 may be positioned along a radially inner portion of the span 128, such as between the zero percent 130 of the span 128 and seventy-five percent 134 of the span 128. It may not be necessary to include the inserts 158 along radially outer portions of the span 128, such as between the seventy-five percent 134 of the span 128 and one hundred percent 132 of the span 128, because it is desirable to use all available cooling capacity in the coolant 172 to cool this portion of the airfoil 114.

Conventional rotor blades may allow direct contact between the airfoil and all of the coolant flowing through the passages defined by the airfoil. Since the coolant absorbs heat as the coolant flows through the airfoil, a large volume of coolant may be necessary to ensure that temperature of the coolant remains low enough to provide adequate cooling to the tip and/or tip shroud. The rotor blade 100, however, isolates a portion of the coolant 172, namely the coolant 172 flowing through the first tube 150, from the airfoil 114. As such, this coolant 172 remains cooler than the coolant flowing through conventional rotor blades. In this respect, the rotor blade 100 requires less coolant conventional rotor blades, thereby increasing the efficiency of the gas turbine engine 10.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A rotor blade for a turbomachine, comprising:

an airfoil defining a span extending from a root of the airfoil to a tip of the airfoil, the airfoil further defining a passage extending from the root to the tip, the passage including a first passage portion extending from the root to a span position located between the root and the tip and a second passage portion extending from the span position to the tip, the first passage portion having a greater diameter than the second passage portion;

a tip shroud disposed radially outward from the tip of the airfoil;

a first tube positioned within the first passage portion, the first tube being spaced apart from the airfoil;

a second tube positioned within the first passage portion such that the second tube is positioned radially inward of the second passage portion, the second tube being spaced apart from and surrounding the first tube; and a plurality of inserts positioned within the first passage portion, the plurality of inserts being positioned between and in contact with the first and second tubes, wherein each of the plurality of inserts defines a perforation extending through the insert along the span, wherein the perforation is configured to allow a flow of coolant to pass between the first tube and the second tube.

2. The rotor blade of claim 1, wherein the span position is located at seventy-five percent of the span.

3. The rotor blade of claim 1, wherein the second tube is in contact with the airfoil.

4. The rotor blade of claim 1, wherein the first tube has a first tube inner diameter and the second passage portion has a second passage portion diameter, the first tube inner diameter being the same as the second passage portion diameter.

5. The rotor blade of claim 1, wherein the first tube and the second tube are concentric.

6. The rotor blade of claim 1, wherein the first tube and the second tube are non-concentric.

7. The rotor blade of claim 1, wherein each of the plurality of inserts is spaced apart from another along the span.

8. The rotor blade of claim 1, wherein the plurality of inserts is non-uniformly spaced apart from one another along the span.

9. The rotor blade of claim 1, wherein the plurality of inserts is in sliding engagement within one of the first tube or the second tube.

10. The rotor blade of claim 1, wherein the plurality of inserts is fixedly coupled to the first tube and the second tube.

11. A turbomachine, comprising:

a turbine section including one or more rotor blades, each rotor blade comprising:

an airfoil defining a span extending from a root of the airfoil to a tip of the airfoil, the airfoil further defining a passage extending from the root to the tip, the passage including a first passage portion extending from the root to a span position located between the root and the tip and a second passage portion extending from the span position to the tip, the first passage portion having a greater diameter than the second passage portion;

a tip shroud disposed radially outward from the tip of the airfoil;

a first tube positioned within the first passage portion, the first tube being spaced apart from the airfoil;

a second tube positioned within the first passage portion such that the second tube is positioned radially inward of the second passage portion, the second tube being spaced apart from and surrounding the first tube; and a plurality of inserts positioned within the first passage portion, the plurality of inserts being positioned between and in contact with the first and second tubes, wherein each of the plurality of inserts defines a perforation extending through the insert along the span, wherein the perforation is configured to allow a flow of coolant to pass between the first tube and the second tube.

12. The turbomachine of claim 11, wherein the span position is located at seventy-five percent of the span.

13. The turbomachine of claim 11, wherein the second tube is in contact with the airfoil.

14. The turbomachine of claim 11, wherein the first tube has a first tube inner diameter and the second passage portion has a second passage portion diameter, the first tube inner diameter being the same as the second passage portion diameter.

15. The turbomachine of claim 11, wherein the first tube and the second tube are concentric.

16. The turbomachine of claim 11, wherein the first tube and the second tube are non-concentric.

17. The turbomachine of claim 11, wherein each of the plurality of inserts is spaced apart from another along the span.

18. The turbomachine of claim 11, wherein the plurality of inserts is non-uniformly spaced apart from one another along the span.

19. The turbomachine of claim 11, wherein the plurality of inserts is in sliding engagement within one of the first tube or the second tube.

* * * * *